United States Patent [19]

Hall

[11] 3,987,507

[45] Oct. 26, 1976

[54] PRESSURE DISTRIBUTION PAD ASSEMBLY FOR WHEELCHAIRS

[75] Inventor: Matthew Hall, N. Hollywood, Calif.

[73] Assignee: Everest & Jennings, Inc., Los Angeles, Calif.

[22] Filed: Aug. 25, 1975

[21] Appl. No.: 607,360

[52] U.S. Cl. ..... 5/338; 5/327 R; 5/337; 5/DIG. 2

[51] Int. Cl.[2] ..... A47C 27/14; A47C 27/15; A61G 7/06

[58] Field of Search..... 5/337, 338, 327 R, DIG. 2, 5/345 R; 297/DIG. 2, DIG. 4, DIG. 5

[56] References Cited

UNITED STATES PATENTS

| | | | |
|---|---|---|---|
| 1,742,186 | 1/1930 | Claus | 5/DIG. 2 |
| 2,234,506 | 3/1941 | Sistig | 5/338 |
| 2,354,436 | 7/1944 | Stedman | 297/DIG. 5 |
| 2,659,418 | 11/1953 | Berman | 5/338 |
| 2,933,738 | 4/1960 | Whelan | 5/338 |
| 2,940,088 | 6/1960 | Boos | 5/327 R X |
| 3,158,878 | 12/1964 | Pernell | 5/338 |
| 3,222,694 | 12/1965 | Schick | 5/338 |
| 3,394,414 | 7/1968 | Unger | 5/345 R |
| 3,626,526 | 12/1971 | Viel | 5/338 X |
| 3,924,283 | 12/1975 | Shave | 5/338 |
| 3,939,508 | 2/1976 | Hall et al. | 5/345 R |

*Primary Examiner*—Paul R. Gilliam
*Assistant Examiner*—Carl F. Pietruszka
*Attorney, Agent, or Firm*—Ralph B. Pastoriza

[57] ABSTRACT

The pad assembly is made up of three pads of resilient foam material assembled one on top of the other, the center pad having a greater density than the outer pads. The center pad has three cut-out openings at locations corresponding to the maximum pressure points exerted by a person sitting on the pads, these openings including a filler foam of density less than that of the outer pads, the overall assembly distributing pressure against a person seated thereon.

3 Claims, 4 Drawing Figures

PRESSURE DISTRIBUTION PAD ASSEMBLY FOR WHEELCHAIRS

This invention relates generally to seat pads and more particularly to an improved pressure distribution pad for wheelchairs.

BACKGROUND OF THE INVENTION

Conventional set pads oftentimes are made from foam rubber or equivalent plastic foam material. Others include liquid filling the entire pad or disposed in individual compartments. While these pads provide more comfort than a flat hard surface to a person seated thereon, there still does not result a desired type support in that the reaction of the pad is uniform over the entire surface and a seated individual tends to shift or roll from side to side or from forward to rearward positions. There is thus a certain degree of "instability".

To overcome this problem, it has been proposed to provide pads which are contoured or which are made of compositions which have a "memory". In both instances, it is usually required that the seated individual remain in the same position all the time in order to realize the best pressure distribution. In other words, the pressure points must rest within the contoured areas if the pad is to be effective.

Other type pads have incorporated a gel material or similar semi-viscous substance, but in these cases as in the case of simple foam rubber, the seating platform tends to shift and roll.

The foregoing problems are particularly acute when such pads are utilized in wheelchairs. Paraplegics are confined for great periods of time in a wheechair in a sitting position. It is vitally important to avoid skin sores and the like, and towards this end pressure distribution must be realized without introducing shear forces and without sacrificing stability.

BRIEF DESCRIPTION OF THE PRESENT INVENTION

With the foregoing in mind, the present invention contemplates a vastly improved seat pad assembly particularly useful for wheelchairs in which an individual is seated for long periods of time. Essentially, this improved seat pad assembly minimizes any skin sores or tendencies for the skin to break down, the arrangement being such as to distribute pressure away from pressure points at such locations so that it can be absorbed in the fleshy areas which are better able to support the body weight. Essentially, this desired result is accomplished without sacrificing stability in the proper support of a patient, particularly in the case of a paraplegic.

Briefly, rather than utilizing liquids, semi-viscous gel materials or simple foam rubber or plastic foam rubber or plastic foam, a pad assembly of resilient foam material is provided having interior cut-out portions at locations corresponding to those locations at which maximum pressures are exerted by a person seated on the pad assembly. These cutout portions are filled with a foam material of less density than the density of the remaining pad assembly.

In the preferred embodiment, these cut-outs are formed in the center pad of a pad assembly made up of three pads, the outer pads sandwiching the center pad and having a lesser density than the center pad, but greater than the filler foam material in the openings. A removable exterior covering is provided for the pad assembly, the three pads functioning together to provide a synergistic effect in that the complete assembly distributes pressure and provides stability in a manner which cannot be accomplished by a single foam cushion.

BRIEF DESCRIPTION OF THE DRAWINGS

A better understanding of the invention will be had by referring to the accompanying drawings, in which.

DETAILED DESCRIPTION OF THE PREFERRED EMBODIMENT

Figure 1:
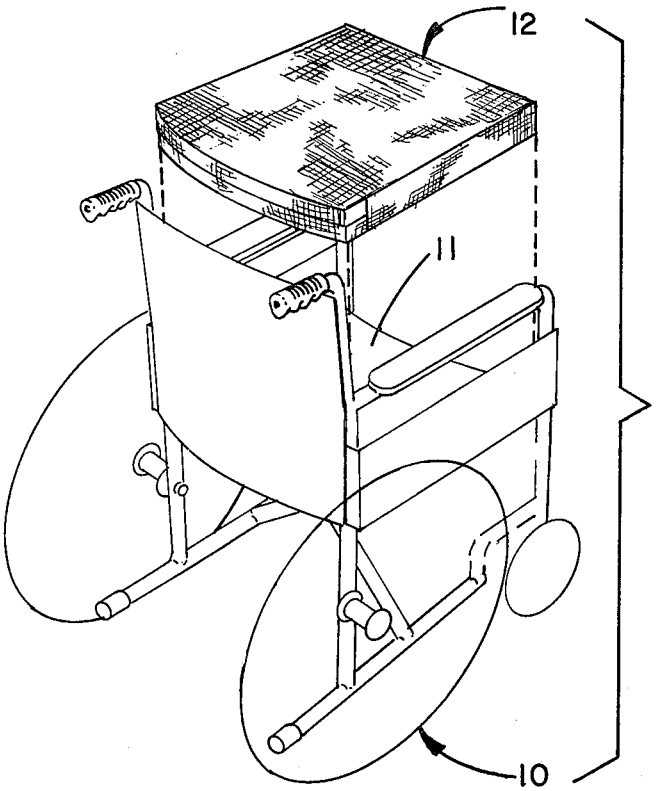
FIG. 1 is a perspective view of a wheelchair showing the seat pad assembly of this invention in exploded relationship above the chair.

Referring first to FIG. 1 there is shown a typical wheelchair having a normal seat 11 upon which a seat pad assembly constructed in accord with the present invention may be used. In FIG. 1, the pad assembly is shown in exploded relationship at 12.

Figure 2:
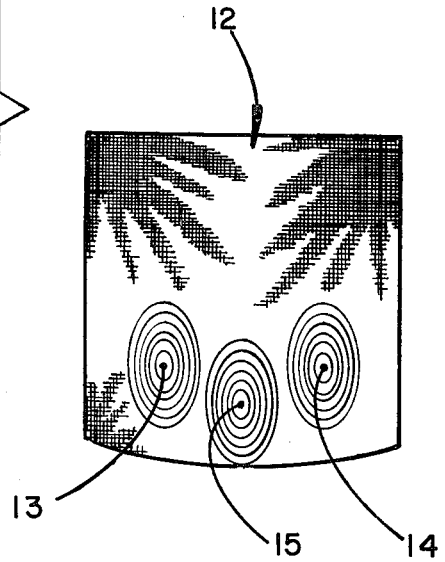
FIG. 2 is a plan view of the pad assembly of FIG. 1 including concentric ellipses illustrative of maximum pressure areas exerted on the pad assembly when a person is seated thereon.

Referring to the plan view of FIG. 2, there is graphically illustrated by the concentric ellipses having centers at 13, 14, and 15, the three major pressure areas exerted on the pad assembly when a person is seated thereon. These pressure points were actually determined by examining X-rays taken of a seated person from various angles. In the absence of the pad assembly of the present invention, 75 percent of the weight of a person is concentrated in these three areas and as a result, skin breakdown occurs.

As described, the seat pad assembly of the present invention provides a construction wherein pressure is distributed without resulting in a tendency to develop shear forces or for a patient to "roll" on the assembly. The design is such that the patient is "stable" and yet is not confined to one position as would occur with a contoured cushion or those of the type incorporating memory pads.

Figure 3:
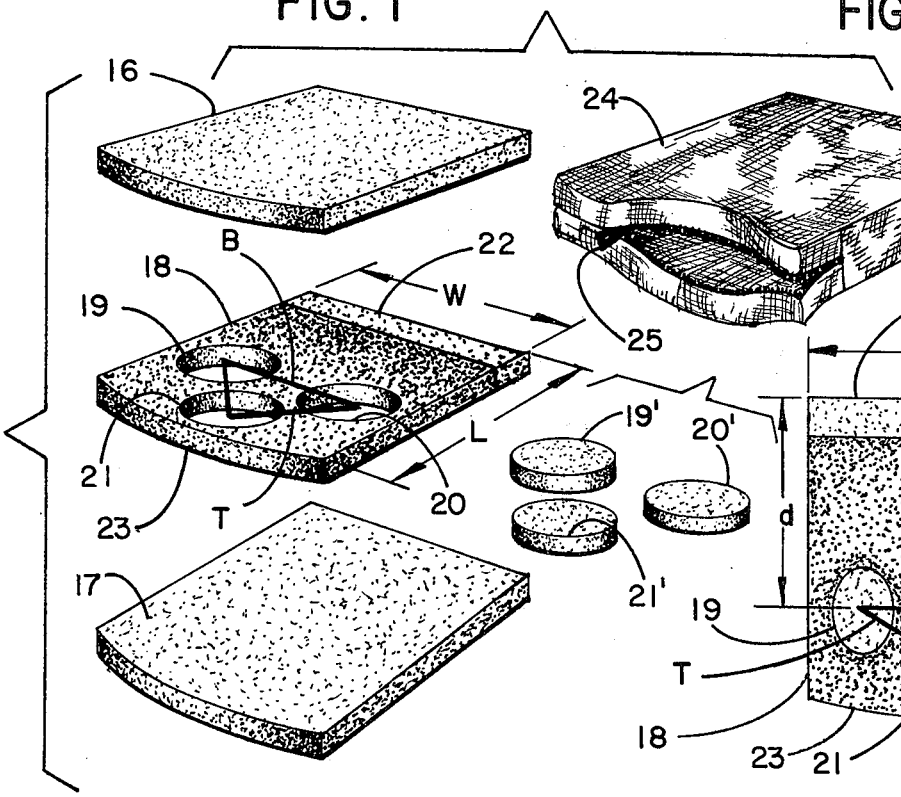
FIG. 3 is an enlarged perspective exploded view of the components making up the pad assembly of FIG. 1; and, FIG. 4 is a plan view of the center pad component of the assembly.

FIG. 3 illustrates the basic components of the assembly. Essentially, the assembly includes first and second outside pads 16 and 17 of resilient foam material of a given density. A center pad 18 of resilient foam material is provided but of a density greater than the given density of either of the outside pads, this center pad being sandwiched between the outside pads.

The center pad 18 is provided with three cut-outs 19, 20 and 21 defining openings passing completely through the center pad. The centers of these openings correspond to the center points 13, 14 and 15 described in FIG. 2. Essentially they are positioned on the vertices of an imaginary isosceles triangle T in the plane of the center pad 18 wherein the base B of the isosceles triangle is parallel to the front edge of the pad and spaced therefrom a given distance. The opening at 21 is disposed at the vertex of the triangle opposite to the base side between the base side and the rear edge of the pad. The openings 19, 20, and 21 incorporate filler foam material 19', 20', and 21' shown separated from the openings to the right side of the center pad in FIG. 3. This filler foam has a density less than the given density of the outside pads.

In the preferred embodiment, the front edge of the center pad 18 terminates in a straight strip of resilient foam material 22 of the same density as that of the foam making up the outside pads 16 and 17. This density is less than the density of the remaining portion of the center pad 18 and serves to permit the cushion more readily to contour to the under-side of a patient's thighs close to his knees when seated on the pad. The front edge is straight for the center pad 18 as well as for the outside pad 16 and 17 and extends for a width W as indicated.

The rear edge 23 of the center pad 18 as well as that of the outside pads 16 and 17 is convexely curved. This convex curvature not only provides a geometry for the pads better capable of accommodating the three openings 19, 20 and 21 when in the triangular configuration, but in addition, distinguishes clearly the rear of the pad assembly from the front of the pad assembly. In this respect, since the openings are closer to the rear of the pad than the front, it is important that the pad be properly oriented on the seat when in use, and the curved edge will thus always indicate to a user the rear edge of the pad assembly.

Also shown in FIG. 3 is an exterior cover 24 arranged to enclose the pads. This cover is provided with a manually operable closure means such as a zipper 25 at the rear of the cover. The cover 24 itself is of a fire retardant porous cloth material and can be easily removed for cleaning such as by simple washing in a machine.

Figure 4:
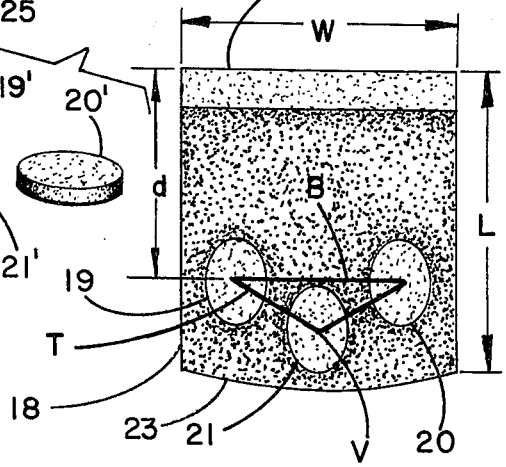

FIG. 4 illustrates in plan view the preferred location of the openings 19, 20, and 21 with the filler foam at the vertices of the isosceles triangle T as described in FIG. 3. The vertex angle of this triangle is indicated at V and could range from 30° to 120° although in the preferred embodiment it is about 85° . It will also be noted that the spacing of the base side B of the triangle T from the extreme front edge of the pad is indicated at *d*, this distance being slightly greater than one half the overall length L of the pad.

The openings at the vertices of the triangle defining the base angles; that is, the openings 19 and 20 are equal in area, the opening at the vertex V shown at 21 opposite the base side being of less area than either one of the other openings. All the openings are preferably oval in shape as shown.

The size of the cut-outs or openings is proportioned in accord with the relative pressures applied at the respective points. Since more pressure is applied at the location of the openings 19 and 20 than at the location of the opening 21, the former openings 19 and 20 are of larger area.

The absolute size of the openings relative to the remaining dimensions of the pad assembly can be varied depending upon the relative densities of the foam making up the center pad, the foam making up the outer pads, and the filler foam material. Where the center pad has a substantially greater density than the outer pads, the openings will be somewhat larger than would be the case if the density of the center pad more nearly approach that of the outer pads. The maximum limits of the size of the openings are such that the total volume of material removed is between one-eighth and one-half the volume of the center pad.

All of the foam materials making up the pad assembly are fire retardant. In the preferred embodiment, the density of the center pad is approximately twice the given density of the outside pads while the density of the filler foam material is approximately two-thirds this given density. The area of the rearward most opening at the vertex of the triangle is approximately one-half the area of either of the other two openings and the total volume of filler foam material is approximately one-fourth the volume of the center pad.

The term "approximately" as used herein is meant to define the proportions within plus or minus 10 percent, for the preferred embodiment although values outside these ranges are possible as indicated heretofore.

OPERATION

When the components of the assembly illustrated in FIG. 3 are assembled together such that the outer pads 16 and 17 sandwich the center pad 18 therebetween, the openings are filled with the filler foam 19',20', and 21', and the same are all enclosed within the exterior cover 24, the pad assembly may be placed on the seat 11 of a wheelchair such as shown in FIG. 1 with the convex curved edge at the rear of the seat. Preferably, the assembly is symmetrical with respect to its top and bottom surfaces so that either the top or bottom side may face up. However, it is important that the curved rear edge be positioned at the rear of the seat or support surface for the pad assembly.

When a patient is seated in the chair on the pad assembly, the underside front portion of his thighs close to his knees will be comfortably cradled by the foam strip 22 at the front edge of the center pad which, as stated, is of less density than the remaining foam making up the center pad. Thus, the pad can more easily "flex" at this front edge.

The relatively greater density of the center pad will tend to stabilize the patient seated on the pad since less "roll" or shifting can occur in the center pad than is possible with the less density outside pads so that the cut-out openings will remain substantially at their designed locations. With the weight of the patient pressing down on the assembly, particularly at the pressure points described in FIG. 2, the top pad will have those portions overlying the openings merge downwardly into the softer filler foam in the openings thus automatically contouring itself to distribute the concentrated pressure at the specific locations to comfortably support the patient. The peripheral portions of the openings in the center pad will provide reactive forces on the fleshy part of the seated patient surrounding the points of maximum pressure concentration. Essentially, the cut-outs at the three critical areas with the filler foam material distributes the pressure away from the pressure points and also reduces shear forces which otherwise would tend to build up pressure. Further, and as mentioned heretofore, the provision of different foam densities makes it possible to distribute the pressure without sacrificing stability.

The entire pad assembly itself is relatively light and the exterior cover 24 is made of porous cloth material so that the pad can "breath".

From the foregoing description, it will be evident that the present invention has provided a greatly improved pressure distribution pad assembly particularly applicable to use with wheelchairs wherein patients must sit for long periods of time.

What is claimed is:

1. A pressure distribution pad assembly for a wheelchair comprising, in combination:

a. first and second outside pads of resilient foam material of a given density;

b. a center pad of resilient foam material of density greater than said given density, sandwiched between said outside pads, the front edges of the pads being straight and in which the rear edges are convexly curved in the plane of the pads, said center pad having three cut-outs defining openings therethrough positioned on the vertices of an imaginary isosceles triangle in the plane of the center pad, the openings at the vertices of the triangle defining the base angles being equal in area, the opening at the vertex opposite the base side being of less area than either one of the other openings, and, wherein the base of said isosceles triangle is parallel to the front edge of the pad and spaced therefrom a given distance, greater than one half the length of the pad the opening at the vertex of the triangle opposite the base side being between the base side of the triangle and rear edge of the pad, the vertex angle being between 30° and 120°;

c. filler foam material in said openings of density less than said given density, said filler foam material comprising a total volume between one eighth and one half the volume of said center pad; and d. a cover enclosing the pads, said cover having manually operable closure means permitting removal of the pads therefrom so that said cover can be cleaned and the pads reinserted, the seat cushion being symmetrical with respect to its top and bottom surfaces so that it functions to distribute the pressure exerted on a person seated on either the top or bottom surface with the convex rear portion adjacent the rear of the person, said pressure distribution resulting from said cut-out openings containing said filler foam material in the center pad.

2. A pressure distribution pad assembly according to claim 1 in which the front edge of said center pad terminates in a straight strip of resilient foam material of density equal to said given density.

3. A pressure distribution pad assembly according to claim 1, in which the foam materials making up said pads are fire retardant and said cover is made of fire retardant porous material, the density of said center pad being approximately twice said given density of said outside pads and the density of said filler foam material being approximately two-thirds said given density, said vertex angle being approximately 85°, the area of the opening at said vertex being approximately one half the area of either of the other two openings, and the total volume of said filler foam material being approximately one fourth the volume of said center pad.

* * * * *